US009105230B2

(12) United States Patent
Kim et al.

(10) Patent No.: US 9,105,230 B2
(45) Date of Patent: Aug. 11, 2015

(54) ORGANIC LIGHT EMITTING DIODE DISPLAY AND METHOD OF DRIVING THE SAME

(75) Inventors: Ki-Wook Kim, Yongin (KR); Wang-Jo Lee, Yongin (KR); Dae-Hyun Noh, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 235 days.

(21) Appl. No.: 13/460,520

(22) Filed: Apr. 30, 2012

(65) Prior Publication Data

US 2013/0208015 A1 Aug. 15, 2013

(30) Foreign Application Priority Data

Feb. 13, 2012 (KR) ..... 10-2012-0014280

(51) Int. Cl.
*G09G 3/32* (2006.01)

(52) U.S. Cl.
CPC ..... *G09G 3/3208* (2013.01); *G09G 2320/0233* (2013.01); *G09G 2320/0666* (2013.01)

(58) Field of Classification Search
CPC ..... G09G 3/30; G09G 3/3208; G09G 2300/0809; G09G 2310/0275; G09G 2320/0233
USPC ..... 345/82, 76
See application file for complete search history.

(56) References Cited

U.S. PATENT DOCUMENTS

| | | | | |
|---|---|---|---|---|
| 7,545,347 | B2 * | 6/2009 | Kanda | 345/76 |
| 8,519,913 | B2 * | 8/2013 | Choi | 345/76 |
| 2002/0011976 | A1 * | 1/2002 | Hashimoto | 345/76 |
| 2005/0219164 | A1 * | 10/2005 | Tanada | 345/76 |
| 2006/0044237 | A1 | 3/2006 | Lee et al. | |
| 2010/0157189 | A1 * | 6/2010 | Ma | 349/48 |
| 2010/0277449 | A1 | 11/2010 | Kanda | |
| 2011/0128268 | A1 * | 6/2011 | Kim et al. | 345/211 |
| 2012/0139959 | A1 * | 6/2012 | Kim | 345/690 |

FOREIGN PATENT DOCUMENTS

| | | | |
|---|---|---|---|
| KR | 10-2005-0076734 | A | 7/2005 |
| KR | 10-2006-0018762 | A | 3/2006 |
| KR | 10-2010-0046210 | A | 5/2010 |

* cited by examiner

*Primary Examiner* — Chanh Nguyen
*Assistant Examiner* — Yuzhen Shen
(74) *Attorney, Agent, or Firm* — Knobbe, Martens, Olson & Bear, LLP

(57) ABSTRACT

An organic light emitting diode (OLED) display is disclosed. In one embodiment, the OLED display includes a panel including pixels which are configured to control an amount of current that flows from a first power source to a second power source to generate an image of predetermined brightness. The display may also include at least one first power source line formed on a top of the panel and at least one second power source line positioned on a bottom of the panel to face the first power source line. The display may further include a first switch configured to alternately supply the first power source to the first power source line and the second power source line.

13 Claims, 5 Drawing Sheets

ORGANIC LIGHT EMITTING DIODE DISPLAY AND METHOD OF DRIVING THE SAME

CROSS-REFERENCE TO RELATED APPLICATION

This application claims priority to and the benefit of Korean Patent Application No. 10-2012-0014280, filed on Feb. 13, 2012, in the Korean Intellectual Property Office, the entire content of which is incorporated herein by reference.

BACKGROUND

1. Field

The described technology generally relates to an organic light emitting diode (OLED) display and a method of driving the same, and more particularly, to an OLED display capable of improving picture quality and a method of driving the same.

2. Description of the Related Technology

Recently, various flat panel display (FPD) technologies capable of reducing weight and volume that are disadvantages of cathode ray tubes (CRT) have been developed and deployed to the marketplace. These technologies typically include liquid crystal displays (LCD), field emission displays (FED), plasma display panels (PDP), and OLED displays. Among them, OLED displays use organic light emitting diodes that generate light by re-combination of electrons and holes. These displays have high response speed and low power consumption.

An OLED display includes pixels positioned at intersections of data lines and scan lines, a data driver for supplying data signals to the data lines, and a scan driver for supplying scan signals to the scan lines.

The scan driver sequentially supplies the scan signals to the scan lines. The data driver supplies the data signals to the data lines in synchronization with the scan signals.

Pixel circuits are selected when the scan signals are supplied to the scan lines to receive the data signals from the data lines. A pixel circuit that receives a data signal charges a voltage corresponding to a difference between the data signal and a first power source in a storage capacitor. Then, the pixel circuit supplies current corresponding to the voltage charged in the storage capacitor from the first power source to a second power source via an OLED to generate light of predetermined brightness.

SUMMARY

One inventive aspect is an OLED display capable of displaying an image of substantially uniform brightness and a method of driving the same.

Another aspect is an OLED display, including a panel including pixels for controlling an amount of current that flows from a first power source to a second power source to generate light of predetermined brightness, at least one first power source line formed on a top of the panel, at least one second power source line positioned on a bottom of the panel to face the first power source line, and a first switching unit for alternately supplying the first power source to the first power source line and the second power source line.

The first switching unit supplies the first power source to the first power source line and the second power source line no less than one time in one frame period to correspond to a control signal. The first switching unit supplies the first power source to the first power source line in a partial period of one frame to correspond to the control signal and supplies the first power source to the second power source line in a remaining period of the one frame. The first switching unit alternately supplies the first power source to the first power source line and the second power source line based on a frame to correspond to the control signal. No less than three first power source lines and no less than three second power source lines are provided so that the first power source lines and the second power source lines receive a red first power source, a green first power source, and a blue first power source, respectively.

The display further includes a first input terminal positioned on a top of the panel to be adjacent to the first power source line, a second input terminal positioned on a bottom of the panel to be adjacent to the second power source line, and a second switching unit for alternately supplying the second power source to the first input terminal and the second input terminal. The second switching unit supplies the second power source to the second input terminal to correspond to a control signal when the first power source is supplied to the first power source line and supplies the second power source to the first input terminal when the first power source is supplied to the second power source line.

Another aspect is a method of driving an OLED display including pixels for controlling an amount of current supplied from a first power source to a second power source to generate light of predetermined brightness, including alternately supplying the first power source from a first power source line positioned on a top of a panel to a second power source line positioned on a bottom of the panel.

The first power source is supplied to each of the first power source line and the second power source line no less than one time in one frame period. The first power source is alternately supplied to each of the first power source line and the second power source line based on a frame. The second power source is alternately supplied to a first input terminal positioned on the top of the panel and a second input terminal positioned on the bottom of the panel. The second power source is supplied to the second input terminal when the first power source is supplied to the first power source line. The second power source is supplied to the first input terminal when the first power source is supplied to the second power source line.

DETAILED DESCRIPTION

Generally, in an OLED pixel, a desired voltage is not charged in a storage capacitor due to the voltage drop of a first power source so that an image of predetermined brightness is not displayed. For example, the first power source supplies predetermined current to the OLED. A predetermined voltage drop is generated to correspond to the amount of current supplied to the OLED. In this case, a desired voltage is not charged in the storage capacitor that charges the voltage corresponding to the difference between the first power source and the data signal.

Figure 1A:
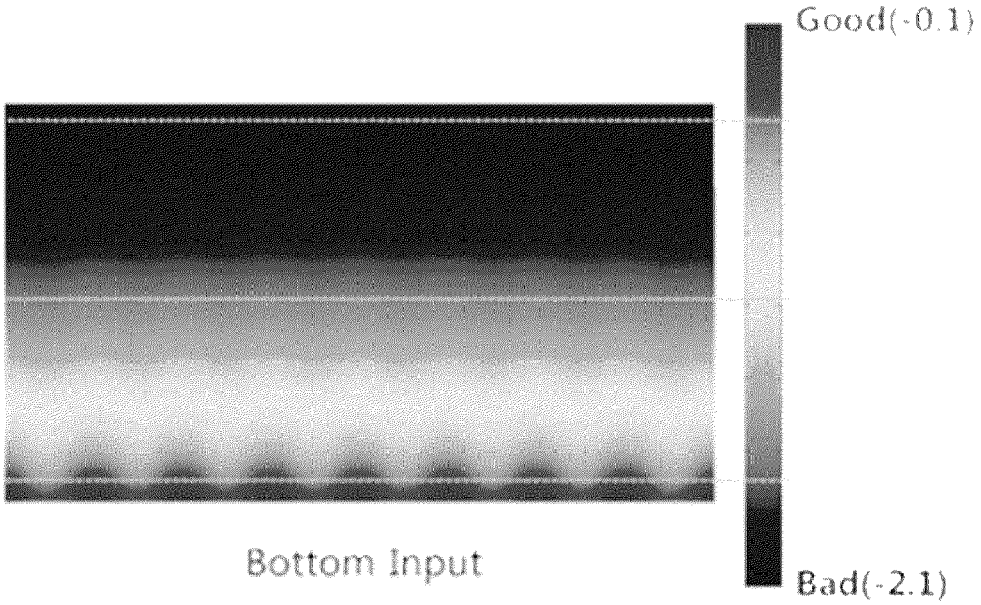
FIGS. 1A and 1B are views illustrating the amount of voltage drop of a first power source corresponding to the supply position of the first power source.
Figure 1B:
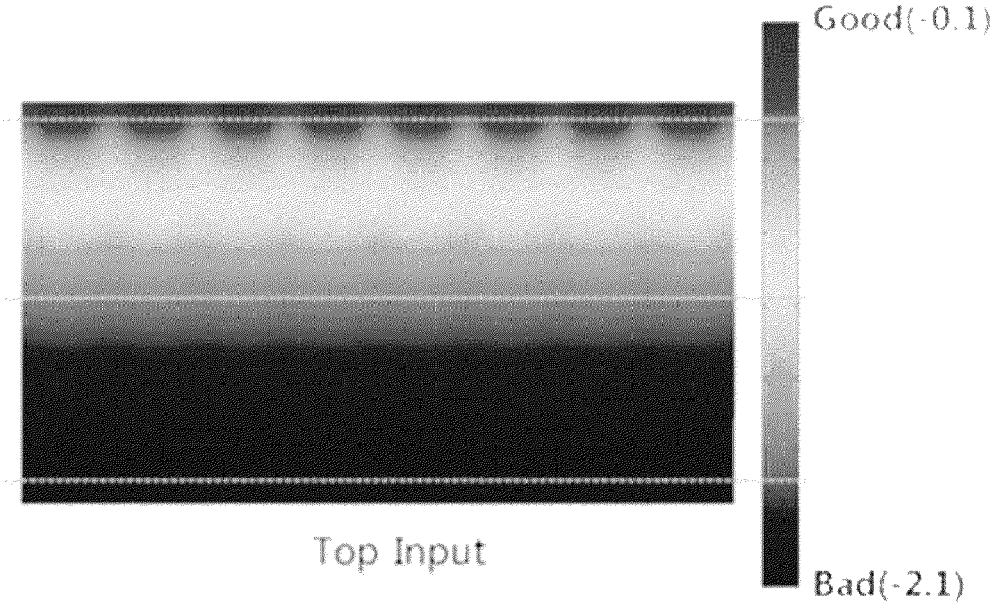

Actually, when the first power is supplied from the bottom of a panel, as illustrated in FIG. 1A, the voltage drop of the first power source increases from the bottom of the panel to the top of the panel. In addition, when the first power source is supplied from the top of the panel, as illustrated in FIG. 1B, the voltage drop of the first power source increases from the top of the panel to the bottom of the panel. In this case, a displayed image becomes non-uniform on the top and bottom of the panel so that an image of desired brightness is not displayed.

Hereinafter, certain embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
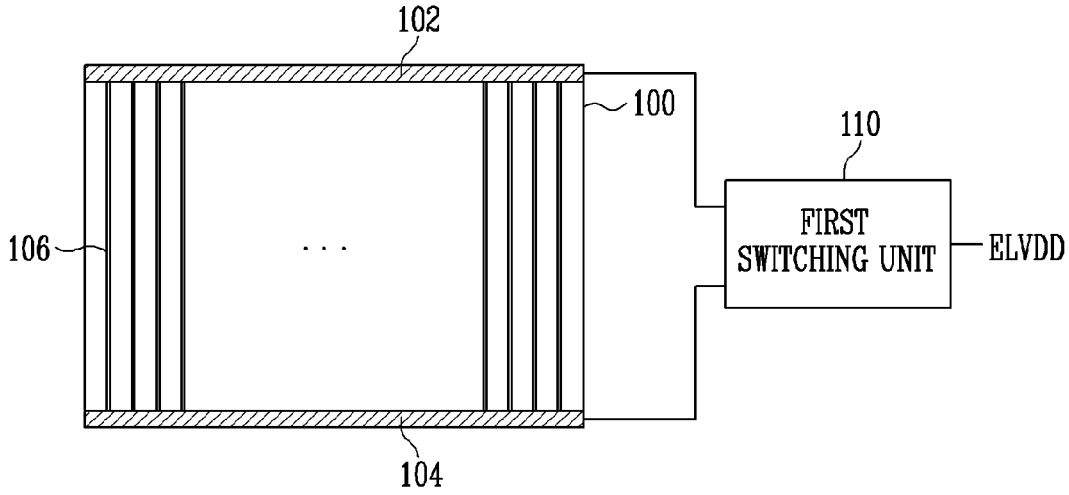
FIG. 2 is a view illustrating an OLED display according to an embodiment.

FIG. 2 is a view illustrating an OLED display according to an embodiment. In FIG. 2, for convenience sake, the supply line of a first power source formed in a panel 100 will be schematically illustrated.

Referring to FIG. 2, the OLED display includes at least one first power source line 102 formed on the top of the panel 100, at least one second power source line 104 formed on the bottom of the panel 100. The display also includes a plurality of coupling lines 106 for electrically coupling the first and second power source lines 102 and 104 to each other. The display further includes a first switching unit (or a first switch) 110 for alternately supplying the voltage of a first power source ELVDD to the first and second power source lines 102 and 104.

The coupling lines 106 are formed in the panel 100 to electrically connect the power source lines 102 and 104. The coupling lines 106 may be electrically coupled to pixels (not shown) to supply the first power source ELVDD to the pixels. On the other hand, in FIG. 2, the coupling lines 106 may be in a stripe type. The coupling lines 106 may also be formed to have currently published various types including a mesh type.

The first power source line 102 receives the first power source ELVDD from the first switching unit 110 and transmits the received first power source ELVDD to the coupling lines 106.

The second power source line 104 faces the first power source line 102. The second power source line 104 receives the first power source ELVDD from the first switching unit 110 and transmits the received first power source ELVDD to the coupling lines 106.

In one embodiment, the first switching unit 110 receives the first power source ELVDD from an external power source (for example, a power source unit) and alternately transmits the received first power source ELVDD to one of the two power source lines 102 and 104. The first power source ELVDD may supply predetermined current to the pixels. Each of the pixels may control the amount of current that flows from the first power source ELVDD to the second power source ELVSS to generate light of predetermined brightness.

Figure 3:
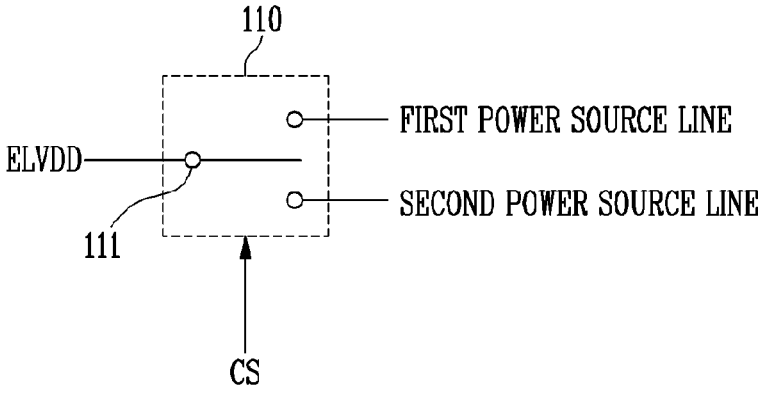
FIG. 3 is a view illustrating the first switching unit of FIG. 2.

FIG. 3 is a view illustrating an embodiment of the first switching unit of FIG. 2.

Referring to FIG. 3, the first switching unit 110 includes a switch 111 for supplying the voltage of the first power source ELVDD to the first power source line 102 or the second power source line 104. The switch 111 transmits the first power source ELVDD to the line 102 or 104 to correspond to a control signal CS.

Figure 4:
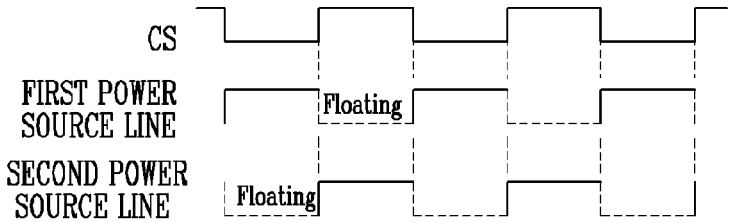
FIG. 4 is a view illustrating the operation processes of the first switching unit corresponding to a control signal.

In one embodiment, as shown in FIG. 4, the switch 111 alternately transmit the first power source ELVDD to the first power source line 102 and the second power source line 104 to correspond to the control signal CS. For example, the switch 111 supplies the first power source ELVDD to the second power source line 104 when the control signal CS is a high level signal and supplies the first power source ELVDD to the first power source line 102 when the control signal CS is a low level signal.

Figure 5A:
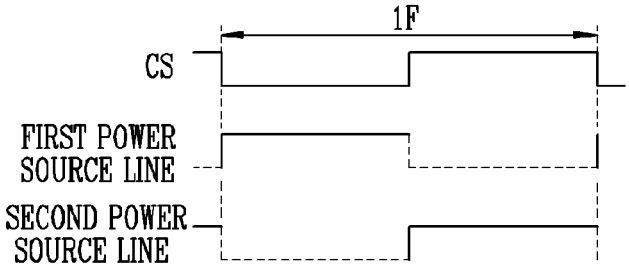
FIGS. 5A and 5B are views illustrating the supply processes of the first power source corresponding to the control signal.

The control signal CS may be supplied from an external device or element, for example, a timing controller (not shown) and be controlled so that a substantially uniform image is displayed on the panel 100. For example, the control signal CS may be controlled so that the first power source ELVDD is supplied to the first power source 102 in a partial period of one frame period and that the first power source ELVDD is supplied to the second power source line 104 in the remaining period of the one frame period as illustrated in FIG. 5A.

As another example, the first power source ELVDD is supplied from the top of the panel 100 in the partial period of the one frame period as illustrated in FIG. 1B and the first power source ELVDD is supplied from the bottom of the panel 100 in the remaining period as illustrated in FIG. 1A. The average amount of the voltage drop of the first power source ELVDD becomes substantially uniform in the one frame period so that a substantially uniform image is displayed.

Figure 5B:
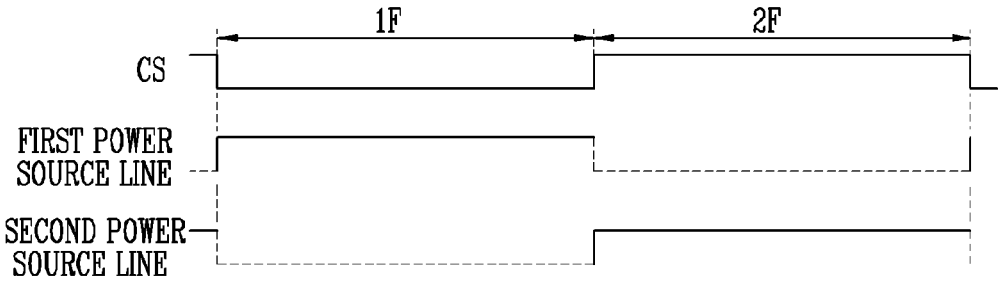

In addition, the control signal CS may be controlled so that the first power source ELVDD is alternately supplied to the first power source line 102 and the second power source line 104 based on a frame as illustrated in FIG. 5B. Then, the average amount of the voltage drop of the first power source ELVDD becomes substantially uniform every two frames so that a substantially uniform image is displayed.

The control signal CS may be supplied in various types so that a substantially uniform image is displayed on the panel 100. For example, the control signal CS may be controlled so that the first power source ELVDD is supplied to the first power source line 102 and the second power source line 104 no less than one time in the one frame period.

Figure 6:
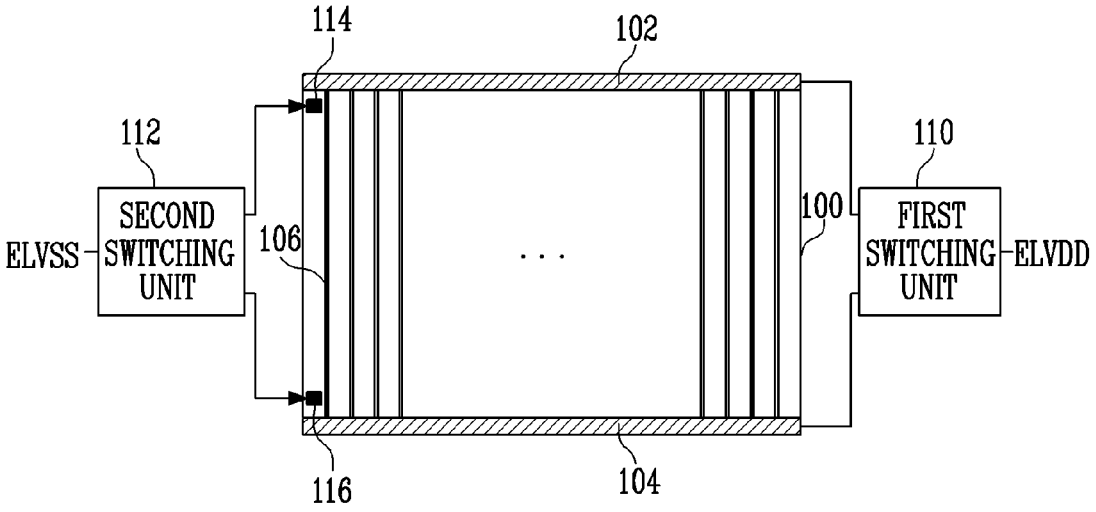
FIG. 6 is a view illustrating an OLED display according to another embodiment.

FIG. 6 is a view illustrating an OLED display according to another embodiment. In FIG. 6, the same elements as those of FIG. 2 are denoted by the same reference numerals and detailed description thereof will be omitted.

Referring to FIG. 6, the OLED display includes a first input terminal 114 positioned to be adjacent to the first power source line 102 on the top of the panel and a second input terminal 116 positioned to be adjacent to the second power source line 104 on the bottom of the panel 100. The display further includes a second switching unit (or a second switch) 112 for alternately supplying the voltage of the second power source ELVSS to the first input terminal 114 and the second input terminal 116.

In one embodiment, the first input terminal 114 for receiving the second power source ELVSS has a limited position and has various structures to correspond to the characteristics of the panel 100. For example, when the second power source ELVSS is supplied via a conductor formed on the front surface of the panel 100 in the form of a plate, the first input terminal 114 is electrically coupled to the plate-shaped conductor on the top of the plate-shaped conductor. In addition, when the second power source ELVSS is supplied to a pixel via mesh or stripe type power source lines, the first input terminal 114 may be longitudinally formed on the top of the panel 100 in a substantially horizontal direction like the first power source line 102.

In one embodiment, the second input terminal 116 for receiving the second power source ELVSS has a limited position and has various structures to correspond to the characteristics of the panel 100 like the above-described first input terminal 114. The first and second input terminals 114 and 116 for receiving the first power source ELVSS may be electrically coupled to each other via coupling lines (not shown) or the plate-shaped conductor.

In one embodiment, the second switching unit 112 receives the second power source ELVSS from an external power source and transmits the received second power source ELVSS to the first input terminal 114 or the second input terminal 116. The second switching unit 112 may alternately supply the second power source ELVSS to the first input terminal 114 and the second input terminal 116.

Figure 7:
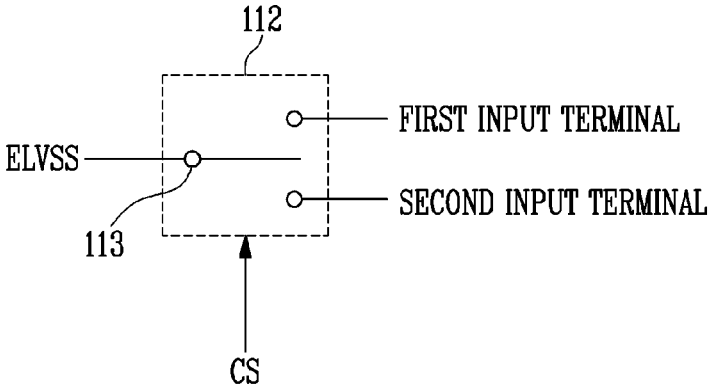
FIG. 7 is a view illustrating the second switching unit of FIG. 6.

FIG. 7 is a view illustrating an embodiment of the second switching unit of FIG. 6.

Referring to FIG. 7, the second switching unit 112 includes a switch 113 for supplying the voltage of the second power source ELVSS to the first input terminal 114 or the second input terminal 116. The switch 113 transmits the second power source ELVSS to the terminal 114 or 116 to correspond to the control signal CS.

Figure 8:
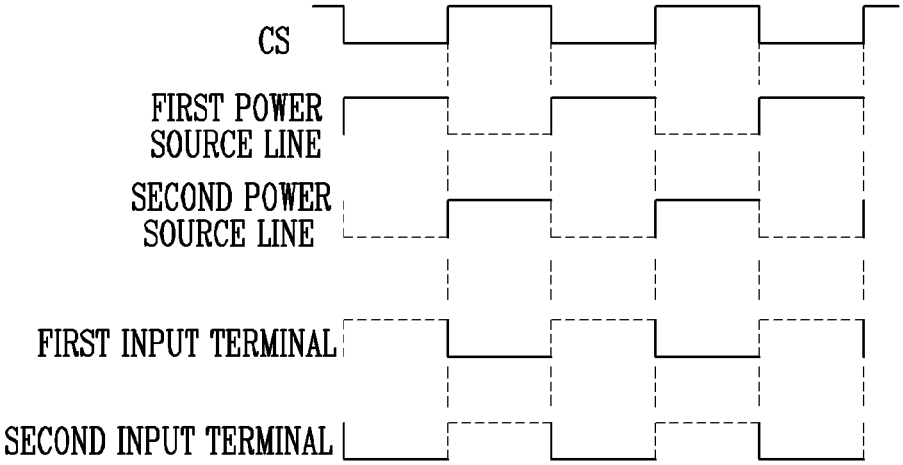
FIG. 8 is a view illustrating the operation processes of the second switching unit corresponding to the control signal.

In one embodiment, the switch 113 transmits the second power source ELVSS to the first input terminal 114 or the second input terminal 116 to correspond to the control signal CS as illustrated in FIG. 8. For example, when the control signal CS is a high level signal, the switch 113 supplies the second power source ELVSS to the first input terminal 114 and supplies the second power source ELVSS to the second input terminal 116 when the control signal CS is a low level signal.

When the second power source ELVSS is supplied to the first input terminal 114, the first power source ELVDD is supplied to the second power source line 104 positioned to face the first input terminal 114. In addition, when the second power source ELVSS is supplied to the second input terminal 116, the first power source ELVDD is supplied to the first power source line 102 positioned to face the second input terminal 114.

In one embodiment, the supply of the first power source ELVDD and the second power source ELVSS is controlled using the first and second switching units 110 and 112. The first and second power sources ELVDD and ELVSS may be controlled not to be adjacent to each other. For example, when the first power source ELVDD is supplied to the top (or bottom) of the panel, the second power source ELVSS is supplied to the bottom (or top) of the panel.

In one embodiment, when the supply positions of the first power source ELVDD and the second power source ELVSS are positioned on the top and bottom of the panel 100, the voltage drop of the sources ELVDD and ELVSS is compensated for so that an image of substantially uniform brightness may be displayed.

In one embodiment, when the first power source ELVDD is supplied to the top of the panel 100, the voltage of the first power source ELVDD is reduced from the top of the panel 100 to the bottom of the panel 100. In another embodiment, when the second power source ELVSS is supplied to the bottom of the panel 100, the voltage of the second power source ELVSS increases from the bottom of the panel 100 to the top of the panel 100. Therefore, regardless of the position of the panel 100, the voltage difference between the two power sources ELVDD and ELVSS may be set to be substantially uniform so that an image of substantially uniform brightness may be displayed.

On the other hand, in the above description, it was assumed that the first power source ELVDD supplied to the panel 100 is commonly supplied to all of the pixels. However, the present disclosure is not limited to the above. For example, the digitally driven OLED display may supply the first power source ELVDD having different voltages to a red pixel, a green pixel, and a blue pixel.

Figure 9:
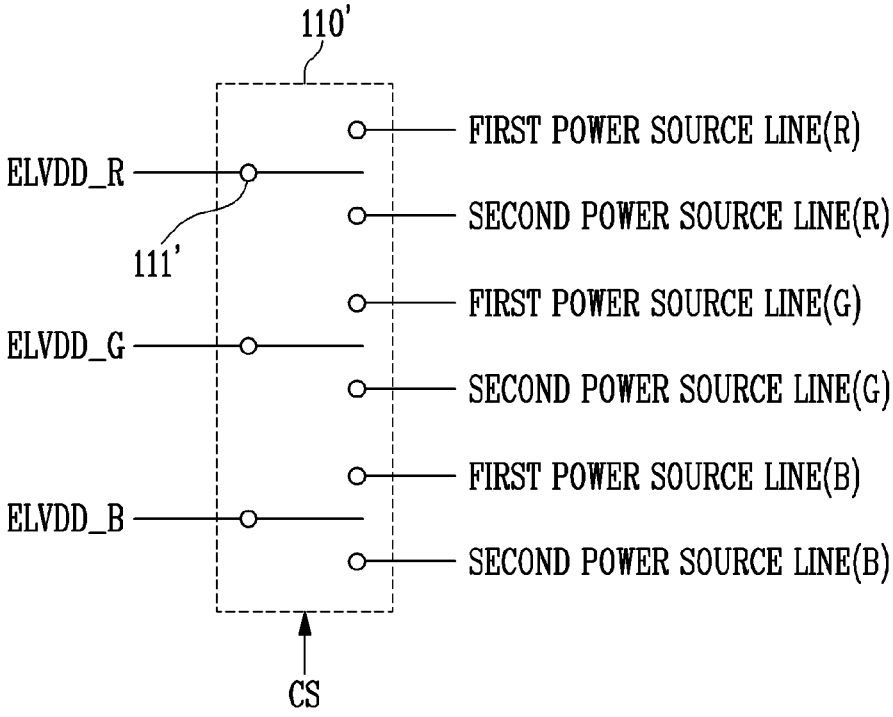
FIG. 9 is a view illustrating another embodiment of the first switching unit of FIG. 2.

In one embodiment, a first switching unit 110' includes three switches 111' in order to control a red first power source ELVDD_R, a green first power source ELVDD_G, and a blue first power source ELVDD_B as illustrated in FIG. 9. Three first power source lines R, G, and B are formed on the top of the panel 100 and three second power source lines R, G, and B are formed on the bottom of the panel 100. In one embodiment, the first switching unit 110' alternately supplies the red, green and blue first power sources ELVDD_R, ELVDD_G and ELVDD_B to the first power source lines R, G, and B, and the second power source lines R, G, and B to correspond to the control signal CS. For example, the red first power source ELVDD_R is alternately supplied to the first and second power source lines R and the green first power source ELVDD_G is alternately supplied to the first power and second source lines G. Also, the blue first power source ELVDD_B is alternately supplied to the first and second power source lines B.

The above description may be applied to a method of supplying the red first power source ELVDD_R, the green first power source ELVDD_G, and the blue first power source ELVDD_B.

According to at least one of the disclosed embodiments, since the first power source is alternately supplied from the top and bottom of the panel, the average amount of voltage drop of the first power source is set to be substantially the same regardless of the position of the panel. Therefore, an image of substantially uniform brightness can be displayed. In addition, the second power source is supplied in the second supply position that faces the first supply position of the first power source so that an average voltage difference between the two power sources may be set to be substantially the same regardless of the position of the panel.

While the above embodiments have been described in connection with the accompanying drawings, it is to be understood that the present disclosure is not limited to the disclosed embodiments, but, on the contrary, is intended to cover various modifications and equivalent arrangements included within the spirit and scope of the appended claims, and equivalents thereof.

What is claimed is:

1. An organic light emitting diode (OLED) display, comprising:

a panel including pixels which are configured to control an amount of current that flows from a first power source to a second power source to generate an image of predetermined brightness, wherein the panel has top and bottom opposing each other and wherein the first and second power sources have different voltage levels;

at least one first power source line formed on the top of the panel;

at least one second power source line positioned on the bottom of the panel to face the first power source line;

a first switch configured to alternately supply the first power source to the first and second power source lines in response to a control signal;

a first input terminal positioned adjacent to the first power source line;

a second input terminal positioned adjacent to the second power source line, wherein the first and second input terminals are not directly connected to the first and second power source lines;

a second switch configured to alternately supply the second power source to the first and second input terminals in response to the control signal; and a conductor directly connected to the first and second input terminals and not directly connected to the first and second power source lines, wherein the first power source is configured to be supplied to the pixels via the first switch and one of the first and second power source lines, wherein the second power source is configured to be supplied to the pixels via the second switch, one of the first and second input terminals, and the conductor.

2. The OLED display as claimed in claim 1, wherein the first switch is configured to supply the first power source to the first and second power source lines at least once in one frame period to correspond to the control signal.

3. The OLED display as claimed in claim 2, wherein the first switch is configured to i) supply the first power source to the first power source line in a partial period of one frame to correspond to the control signal and ii) supply the first power source to the second power source line in the remaining period of the frame.

4. The OLED display as claimed in claim 1, wherein the first switch is configured to alternately supply the first power source to the first and second power source lines based on a frame to correspond to the control signal.

5. The OLED display as claimed in claim 1, wherein the second switch is configured to i) supply the second power source to the second input terminal to correspond to the control signal when the first power source is supplied to the first power source line and ii) supply the second power source to the first input terminal when the first power source is supplied to the second power source line.

6. The OLED display as claimed in claim 1, wherein the conductor has a mesh or plate shape.

7. The OLED display as claimed in claim 1, wherein the first and second switches are arranged on opposing sides of the panel.

8. An organic light emitting diode (OLED) display, comprising:

a panel including pixels which are configured to control an amount of current that flows from a first power source to a second power source to generate an image of predetermined brightness, wherein the panel has top and bottom opposing each other and wherein the first and second power sources have different voltage levels;

at least one first power source line formed on the top of the panel;

at least one second power source line positioned on the bottom of the panel to face the first power source line;

a first switch configured to alternately supply the first power source to the first and second power source lines in response to a control signal;

a first input terminal positioned adjacent to the first power source line;

a second input terminal positioned adjacent to the second power source line, wherein the first and second input terminals are not directly connected to the first and second power source lines;

a second switch configured to alternately supply the second power source to the first and second input terminals in response to the control signal; and a conductor directly connected to the first and second input terminals and not directly connected to the first and second power source lines, wherein the first power source is configured to be supplied to the pixels via the first switch and one of the first and second power source lines, wherein the second power source is configured to be supplied to the pixels via the second switch, one of the first and second input terminals, and the conductor, wherein at least three first power source lines and at least three second power source lines are provided so that the first and second power source lines receive a red first power source, a green first power source, and a blue first power source, respectively.

9. A method of driving an organic light emitting diode (OLED) display including pixels which are configured to control an amount of current supplied from a first power source to a second power source to generate an image of predetermined brightness, the method comprising:

alternately supplying the first power source to a first power source line positioned on a top of a panel and a second power source line positioned on a bottom of the panel in response to a control signal, wherein the top and bottom of the panel are opposing each other, wherein the OLED display comprises a first input terminal positioned adjacent to the first power source line, a second input terminal positioned adjacent to the second power source line, and a conductor directly connected to the first and second input terminals and not directly connected to the first and second power source lines and wherein the first and second input terminals are not directly connected to the first and second power source lines; and alternately supplying the second power source to the first and second input terminals, wherein the first and second power sources have different voltage levels, wherein the first power source is configured to be supplied to the pixels via the first switch and one of the first and second power source lines, wherein the second power source is configured to be supplied to the pixels via the second switch, one of the first and second input terminals, and the conductor.

10. The method as claimed in claim 9, wherein the first power source is supplied to each of the first and second power source lines at least once in one frame period.

11. The method as claimed in claim 9, wherein the first power source is alternately supplied to each of the first and second power source lines based on a frame.

12. The method as claimed in claim 9, wherein the second power source is supplied to the second input terminal when the first power source is supplied to the first power source line, and wherein the second power source is supplied to the first input terminal when the first power source is supplied to the second power source line.

13. The method as claimed in claim 9, wherein the conductor has a mesh or plate shape.

* * * * *